United States Patent [19]

Wolff et al.

[11] Patent Number: 4,932,426

[45] Date of Patent: Jun. 12, 1990

[54] METHOD AND APPARATUS FOR VACUUM CLEANING MINERAL WOOL PRODUCTS WHILE COMPRESSING THE PRODUCT

[75] Inventors: Håkan Wolff, Vänersborg; Gunnar Hartung, Skövde, both of Sweden

[73] Assignee: Rockwool Aktiebolaget, Skovde, Sweden

[21] Appl. No.: 326,656

[22] Filed: Mar. 21, 1989

[30] Foreign Application Priority Data

Mar. 31, 1988 [SE] Sweden ..... 8801204

[51] Int. Cl.[5] ..... B08B 7/02; B08B 5/04; A47L 5/38

[52] U.S. Cl. ..... 134/16; 134/21; 15/303

[58] Field of Search ..... 134/16, 21; 15/303, 15/301, 302, 300 R, 25.4

[56] References Cited

U.S. PATENT DOCUMENTS 4,333,369 6/1982 McCort ..... 83/24

*Primary Examiner*—Asok Pal
*Assistant Examiner*—Ourmazd Ojan
*Attorney, Agent, or Firm*—Nilles & Nilles

[57] ABSTRACT

Method and apparatus for removing fibres and other particles from the surfaces of compressible mineral wool products, for instance, mineral wool plates (2), by means of one or more suction slot nozzles (5) which suck air from adjacent the surfaces of the mineral wool products. The mineral wool products, while being exposed to the suction of slot or slots (5), are subjected to a quick compression so that a part of the air enclosed in the mineral wool is forced out towards the suction slot or slots (5) thereby bringing loose fibres and other particles at and adjacent the surfaces into the suction slot or slots (5).

12 Claims, 2 Drawing Sheets

METHOD AND APPARATUS FOR VACUUM CLEANING MINERAL WOOL PRODUCTS WHILE COMPRESSING THE PRODUCT

BACKGROUND OF THE INVENTION

When handling mineral wool products large or small amounts of dust are formed, which dust includes fibres, among other things. It is a general aim to minimize the amount of dust, including fibrous dust, to which working people are exposed, and the present invention is intended to solve this problem.

The invention is based on studies of the mechanisms which cause appearance of dust and also the mechanisms which can be used to prevent spreading of dust. These studies have shown that the air-borne dust which is produced when handling mineral wool mainly comprises thin, short mineral fibres. The studies also have shown that the air-borne fibres and other particles emanate from the surfaces of the mineral wool products.

There are three mechanisms which, separately or in combination, can keep a fibre in a mineral wool product and can prevent the fibre from becoming air-borne. Said mechanisms are:

binding
fastening
mechanical locking.

The binding is effected by means of a binding substance. The binder generally is a thermosetting resin which in the form of small drops is distributed in the mineral wool products. If such a binder drop sticks to a fibre said fibre is prevented from becoming air-borne.

The fastening is a less heavy binding. The fastening can be effected by means of a dust binding oil, which in the form of a thin layer covers large portions of the fibre surfaces. Two fibres which are in contact with each other, and one fibre of which has an oil film on its surface, get fastened to each other and said fastening generally is sufficient to prevent the fibre from becoming air borne.

Investigations also have proved, however, that another type of fastening is of importance, namely an electrostatic fastening. The process of manufacturing mineral wool products includes a hardening stage in which the product and the binder for the product is heated to about 200° C., whereby the binder is finally hardened. During the hardening stage the product also becomes completely dried, and since the hardening stage is combined with a heavy gas flow through the products the fibres may become electrostatically charged. In the subsequent cutting and packing etc. of the mineral wool product said electrostatic charge is maintained and fibres which have become charged tend to be maintained in the product. Upon storing and transporting, the product, however, becomes discharged and subsequently the fibres, which were once electrostatically fastened, then can become air borne.

The third mechanism for keeping the fibres in the mineral wool mass is the mechanical one. A sufficiently long fibre will always be in contact with a large number of other fibres and said fibre will be kept in the product solely by means of friction and will be prevented from becoming air borne.

The investigations also have shown that some fibres are so loosely fastened in the product, or not fastened at all, that they can easily be sucked off the product in that the product is moved passed a suction nozzle or a suction slot having a sufficient suction capacity. Other fibres and particles are so strongly fastened to the product that they cannot normally be removed from the product. Between said two groups of fibres and particles there is a group of fibres and particles which cannot be easily sucked off the product but which can still become air borne, in particular after the electrostatic force has disappeared.

Mineral wool products having a reasonable density, for instance rock wool products having a density of less than 50 kg/m$^3$ are compressible to a substantial degree. Depending on the low density the porosity of the product is very high, generally more than 95%. Therefore, if such a product is compressed to about half its original thickness, a volume of air corresponding to about half the original volume of the mineral wool body must be pressed out of the product. It has been shown that the air pressed out of the mineral wool body can release and bring a substantial part of the loose fibres at the surface out of the product if the said compressing is made with a sufficient speed. This is the basis of the present invention.

SUMMARY OF THE INVENTION

Thus, the invention relates to a method of removing fibres and other particles from the surfaces of compressible mineral wool products, for instance mineral wool plates, which method is executed by means of one or more slot-like suction nozzles which suck or exhaust air from adjacent the surfaces of the mineral wool products so that loose fibres and other particles are carried with the air into the suction nozzles.

According to the invention the mineral wool products are subjected to a quick compression concurrently with the influence of the suction nozzle or nozzles, so that a part of the air enclosed in the mineral wool is forced out in the direction towards the suction nozzle or nozzles thereby bringing loose fibres and other particles from or adjacent the surfaces into the suction nozzle or nozzles.

Depending on the compression according to the invention the particles which are imperfectly fastening or otherwise kept in the mineral wool mass are subjected to a flow of air from inside the mineral wool mass, which air flow effectively releases fibres and particles. The suction force influencing the fibres and particles concurrently therewith moves said fibres and particles out of the mineral wool mass.

It has shown that such low outflow speed as 0.5 m/sek has a noticable effect on the releasing of the fibres. Air speeds of 1 m/sek, or more preferably 2 m/sek, has been a much better effect.

Surprisingly it has shown that additional fibres are released if the compressing step is repeated. The explanation for this additional release may be that fibres are displaced during the first air outflow and the succeeding air backflow, so that such fibres can be removed during the next air outflow.

Generally mineral wool products are made in layers so that most fibres are oriented parallel to the main plane of the product. This means that the products are most easily compressed by forces which are perpendicular to said planes. At the same time the edges of the products form a relatively small part of the total surface of the products. Therefore, the products may be compressed by means of air tight compressing means using press which are perpendicular to the main planes of the products. The air volume which is thereby caused to flow out through the edge surfaces is relatively large and it is easy to cause such an air flow.

The air flow through the edges can be increased if, in a first compressing step by means of air tight compression plates, air is prevented from flowing out through two opposite edge surfaces, and thus, air is forced to flow out only through the two remaining edge surfaces, and, in a second compressing step, air is allowed to flow out through the two first mentioned edge surfaces. This is a very effective method of releasing particles from the edge surfaces.

It is especially advantageous and practical that the compressing step is executed after the mineral wool product is cut into plates that have been piled in layers one on top of the other. In such case particles can be released from several edge surfaces at the same time. Preferably the amount of plates adapted to form a package are thereby compressed at the same time.

A special problem in the mineral wool manufacture is that it is difficult to effectively suction treat the cut edges of the products while said products are maintained on the manufacturing line. In such case there is normally no space between the edges of two adjacent plates in the partition cut extending longitudinally of the manufacturing line. At the cross cut extending perpendicularly to the advancing direction of the mineral wool path it is indeed possible to provide a space between the mineral wool pieces, but it is still difficult to provide an effective suction treatment of a surface which is perpendicular to the direction of travel of the plates. If, however, cut pieces, of for instance mineral wool, are piled it is possible to remove particles and fibres from the edges of the pile of several mineral wool plates at the same time the entire pile is being compressed.

Likewise, even rolled mineral wool products can be treated. A rolled product can easily be suction treated on both flat surfaces, that is the upper top surface and the bottom surface respectively, but as mentioned above there are problems in treating the edges. If, however, the product is formed into a roll and the roll is violently compressed by applying a pressure to the exterior surface of the roll, air is pressed out of the roll through the edge surfaces thereof. If the edges are thereby suction treated particles and fibres present on the edge surfaces thereby will be permanently removed.

If the compression is made by means of a perforated press plate a part of the air enclosed in the product will flow out through the openings of said press plate. This is especially the case if any other air outflow is prevented. This method of executing the invention is partcularly advantageous for flat products the flat-surfaces of which are be be treated.

The invention also can be executed so that the pressing is made by means of perforated plates in the form of grids or nets so that the air which is pressed out flows, partially or solely through the flat-surfaces of the product. This variation of the invention can be executed in a two-stage process so that, in a first compressing step, a first flat-surface is compressed by means of a perforated press plate and the second opposite flat surface is supported by an air tight surface. In a second compressing step the second flat-surface is compressed by means of a perforated press plate whereas the other or first flat-surface is supported by an air-tight surface.

BRIEF DESCRIPTION OF THE INVENTION

The invention will now be described with reference to FIGS. 1 through 4 which illustrate different methods of pressing fibres and particles out of compressable mineral wool products. The figures are shown in a vertical cross section.

DESCRIPTION OF THE PREFERRED EMBODIMENTS

Figure 1:
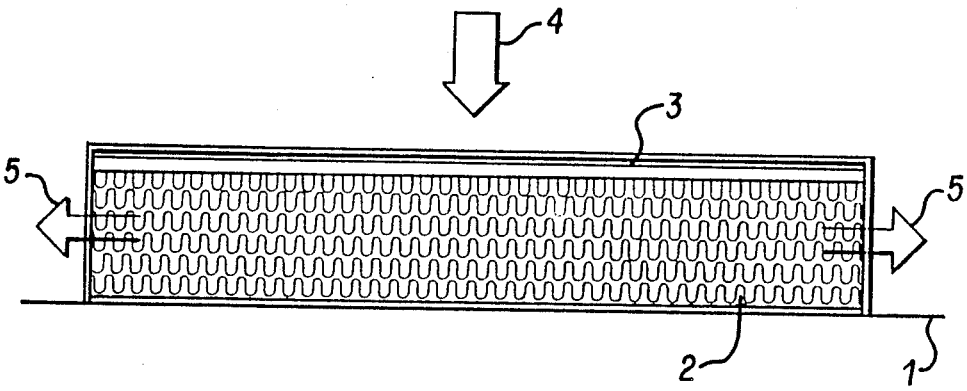
FIG. 1 illustrates the removal of air from a single mineral wool plate utilizing compression force applied to only one side of the plate.

FIG. 1 diagrammatically shows the principle of the invention. A mineral wool plate 2 having main flat top and bottom surfaces and edge surfaces is placed on a support 1. Above the main top surface of the mineral wool plate 2 there is compression applying means which includes an air tight pressure plate 3 which by a force 4 can be pressed against the mineral wool plate 2 to compress it against support 1. A mineral wool plate having a low density, for instance a desity of less than 30 $kg/m^3$ can easily be compressed to e.g. 50% of its original thickness. This means that an air volume substantially corresponding to half the volume of the mineral wool plate must be pressed out of the product. Such compression causes an air flow symbolized by the arrows 5 out of the side surfaces of the product. Obviously the velocity of said air flow is dependant on the speed by which the compression is made. The mineral wool plate, however, is not influenced by said speed. The efficiency of the operation, as concerns releasing of particles, in this case releasing of particles from the edges of the mineral wool plate, therefore is restricted only by the period of time used to effect the compression.

Figure 2:
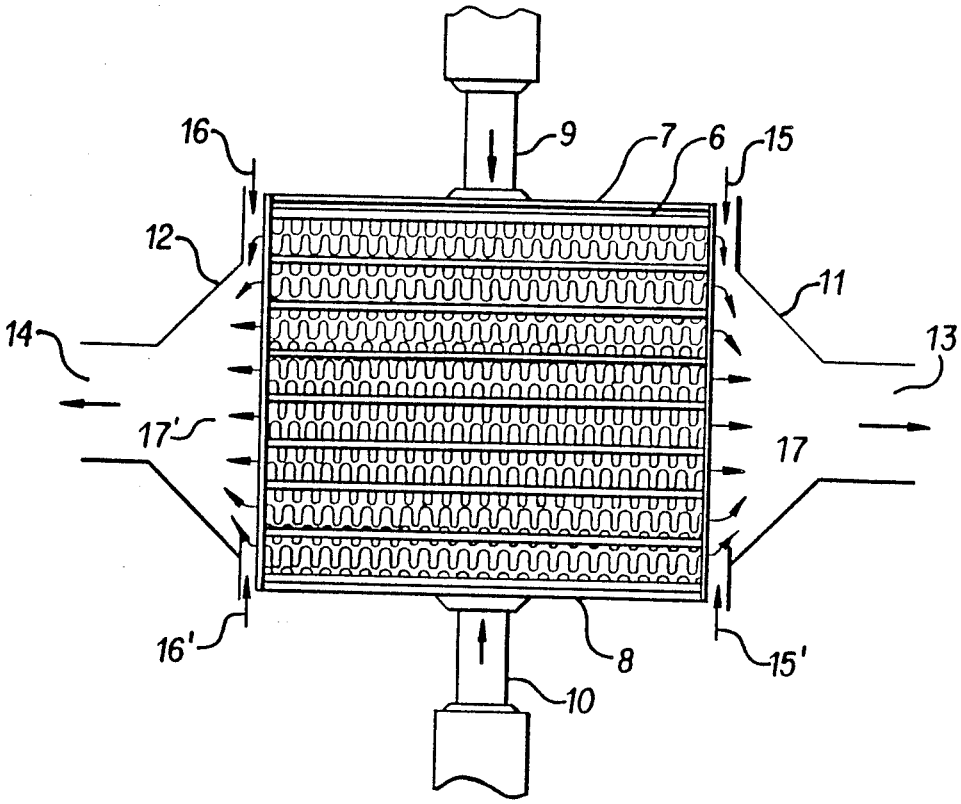
FIG. 2 illustrates the removal of fibres from a pile of mineral wool plates utilizing compression forces applied to both the top and bottom external sides of the pile.

The process indicated in connection to FIG. 1, of course, can as well be executed on a pile of mineral wool plates. Such an embodiment is illustrated in FIG. 2, in which there is illustrated a pile of mineral wool plates 6 positioned between two press plates 7 and 8. The press plates are, in turn, actuatable by the press cylinders 9 and 10 which are designed for exerting a compressive effect during a short period of time. Suction means in the form of apparatus 11 and 12 are mounted around the pile of plates to create a reigon of suction. The suction apparatus 11 and 12 for establishing a region of suction adjacent the surfaces are connected to suction conduits 13 and 14 through which air is exhausted. The air exhausted through conduits 13 and 14 comprises atmospheric air which enters through slots 15, 15' and 16, 16' parallel to the edge surface of the plate in the direction of the arrows shown in the slots and air which is expelled from the pile of mineral wool plates while being compressed. The air flowing out of the pile of mineral wool plates is indicated by the arrows 17 and 17'.

Figure 3:
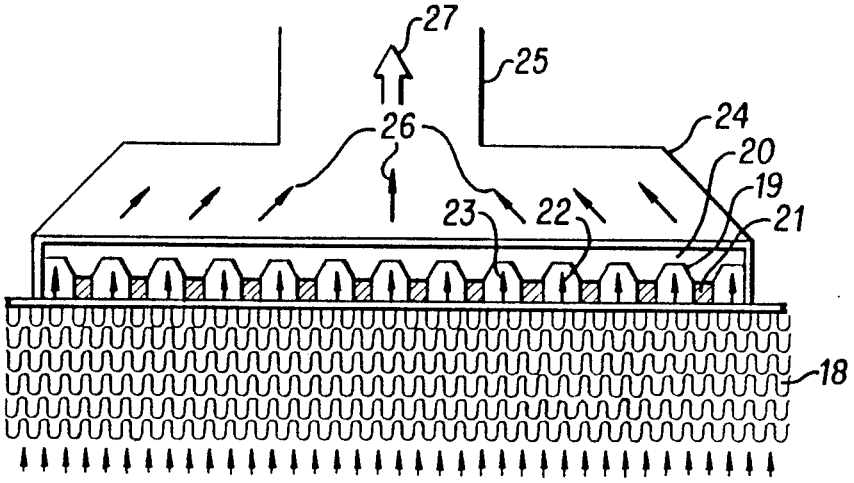
FIG. 3 illustrates the removal of fibres from a mineral wool plate utilizing a perforated plate to apply the compressing force.

FIG. 3 shows an embodiment of the invention in which a plate 18 of mineral wool is being compressed by a press plate 19 comprising two cross support bars 20 and several profiles 21 engaging the mineral wool. Between the profiles 21 there are slots 22. When the press plate 19 is pressed onto the mineral wool plate and compresses same the air present in the mineral wool is at least partly forced up through the slots 22 as indicated by the arrows 23. Round the press plate 19 there is an exhaust hood 24 which is connected to an exhaust conduit 25. The air flows leaving the mineral wool follows the arrows 23, are brought together in the exhaust hood 24 as shown by arrows 26 and leave the exhaust hood 25 as shown by arrow 27.

Figure 4:
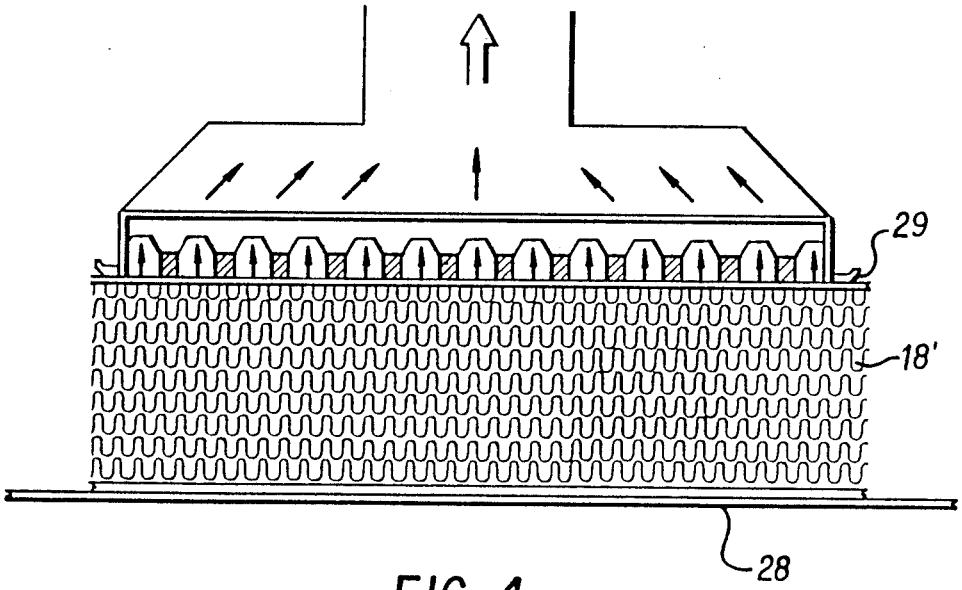
FIG. 4 illustrates the removal of fibres from a mineral wool plate similar to that shown in FIG. 3 but wherein said mineral wool plate is placed on a nonpermeable support.

If the mineral wool plate 18' to be treated is placed on a nonpermeable support 28, as shown in FIG. 4, a large portion of the air which is forced out of the mineral wool plate when it is being compressed will flow up through the upper mineral wool surface 29. Because a large portion of the air is forced to flow through the upper surface 29, of loosly of imperfectly bound particles or fibres from the top surface thereof becomes more effective.

It is to be understood that the described embodiments of the invention are only illustrating examples and that the invention is restricted only by the appended claims.

We claim:

1. A method of removing loose fibres and particles from a compressible resilient product containing expellable air and having top, bottom and side edge surfaces comprising the steps of:

A. placing a compressible resilient product on a support;

B. establishing a region of suction adjacent a surface or two opposite surfaces of said product; and C. compressing said product by causing relative movement between said support and a compression applying means to reduce the volume of said product to the extent required to cause a quick outflow of said expellable air through said surfaces adjacent said region of suction at a velocity which will cause a releasing and carrying of said loose fibres and particles into said region of suction.

2. The method according to claim 1 comprising the further steps of

D. releasing said compression means to allow said product to expand and draw air back into said product; and E. repeating said compressing according to step C.

3. The method according to claim 1 wherein step A further comprises forming said product into individual plates and piling said plates one on top of the other on said support.

4. The method according to claim 1 wherein in step A said bottom surface of said product is placed on said support;

in step B said region of suction is established adjacent said side edge surfaces; and in step C said compressing is applied against said top surface in a direction perpendicular thereto.

5. The method according to claim 1 wherein, in step B, said region of suction includes causing atmospheric air to be aspirated into said region of suction in a direction parallel to said product surfaces that are adjacent said region of suction.

6. The method according to claims 1, 2, 3, 4 or 5 wherein step C further comprises making said compression means air tight to cause all of said expelled air to flow out through said edge surfaces during said compressing step.

7. The method according to claim 1, 2, 3, 4 or 5 wherein step C further comprises providing openings in said compression means so that during said compressing step, part of the air expelled from said product will flow out through said openings to said region of suction.

8. The method according to claim 7 comprising the additional step of (F) covering all of said edge surface before carrying out said compressing of step C to prevent airflow through said edge surfaces so that during said compressing step the outflow of air will only be through said openings in said compression means.

9. The method according to claim 1, 2, 3, 4 or 5 wherein said product has four edge surfaces that are arranged into first and second pairs of opposed spaced apart edge surfaces; and further comprising the additional steps of:

G. after step A, covering said edge surfaces of one of said pairs and establishing said region of suction according to step B adjacent said edge surfaces of said other uncovered pair of edge surfaces;

H. compressing said product to force air to be expelled through said other pair of uncovered edge surfaces;

I. uncovering said one pair of edge surfaces and covering said other pair of edge surfaces; and J. repeating said compressing step to force air to be expelled through said one pair of edge surfaces.

10. An apparatus for removing loose fibres and particles from a compressible resilient product containing expellable air and having top, bottom, and side edge surfaces comprising:

a support onto which one or more of said product can be placed;

suction means for establishing a region of suction adjacent some of said surfaces of said product during operation; and a compression means mounted in spaced opposed relation to said support, said compression means including a means for causing relative movement of said support and compression means toward and away from each other to compress any product placed therebetween during operation to cause a quick outflow of air expelled from said surfaces that are adjacent said region of suction, at a velocity which will cause a releasing and carrying of said loose fibres and particles into said region of suction.

11. An apparatus according to claim 10 wherein said support and said compression means each include an air tight press plate adapted, when in use, to compress said top and bottom surfaces of said product therebetween, and wherein said suction means includes an exhaust hood means positioned closely adjacent said side edge surfaces through which air is expelled during operation.

12. An apparatus according to claim 10 wherein said support and compression means include one or more perforated press plate means having perforations therethrough, said press plate means adapted, when in use, to compress said top and bottom surfaces therebetween, and wherein said suction means includes air exhaust hood means positioned to collect air expelled through said perforations of said perforated press plate means.

* * * * *